United States Patent [19]

Warthen

[11] 4,285,753

[45] Aug. 25, 1981

[54] SYNTHETIC YARN DEVICE

[75] Inventor: William P. Warthen, Spartanburg, S.C.

[73] Assignee: Milliken Research Corporation, Spartanburg, S.C.

[21] Appl. No.: 73,733

[22] Filed: Sep. 10, 1979

[51] Int. Cl.[3] ..... B26F 3/08; B32B 31/18

[52] U.S. Cl. ..... 156/251; 156/350; 156/353; 156/368; 156/515; 156/579

[58] Field of Search ..... 156/251, 515, 350, 353, 156/368, 433, 579

[56] References Cited

U.S. PATENT DOCUMENTS

| | | | |
|---|---|---|---|
| 2,700,317 | 1/1955 | Lilienfeld | 289/18 R |
| 3,772,127 | 11/1973 | James | 156/502 |
| 4,030,743 | 6/1977 | Warthen | 156/515 |
| 4,106,973 | 8/1978 | Wright | 156/515 |

FOREIGN PATENT DOCUMENTS

| | | | |
|---|---|---|---|
| 47-23343 | of 1972 | Japan | 156/515 |

*Primary Examiner*—Caleb Weston

*Attorney, Agent, or Firm*—Earle R. Marden; H. William Petry

[57] ABSTRACT

Apparatus and method to prevent the slippage of a knot in the tied synthetic yarn so that the tied yarns will not separate in the textile operation. The knotted yarns to be locked together actuate the switch to apply heat to the yarns to lock the knot in the yarns and sever the tails of the tied yarns.

4 Claims, 4 Drawing Figures

SYNTHETIC YARN DEVICE

It is an object of the invention to provide a yarn cutting device and a method of use to securely lock one yarn to another when they have been tied together.

Other objects of the invention will become readily apparent as the specification proceeds to describe the invention with reference to the accompanying drawings, in which.

Figure 1:
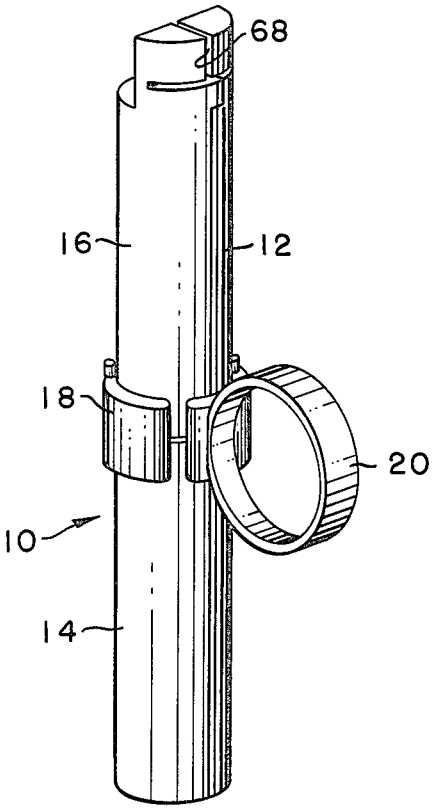
FIG. 1 is an isometric view of the new and improved apparatus.

Looking now to the drawings and especially to FIG. 1, the reference numeral 10 generally designates the new and improved, self-contained, synthetic yarn cutter which is housed in a plastic casing comprising casing members 12, 14 and 16 which are held together by plastic slip ring 18. Slip ring 18 has a finger loop 20 molded thereto to accommodate the finger of the user.

The casing member 12 basically supports the working elements of the yarn cutter. Mounted in the back of the casing member 12 is the connection plate 22 of beryllium copper or other suitable material which forms the return path from the contact button 24 to the positive pole of the battery 25. Secured into channel portions 26 and 28 in the casing member 12 is the plastic block 30 which supports the positive battery connector 32 in contact with the battery 25 to complete the circuit when the device is energized. The negative battery connector 32 consists of the battery contact member 34 and the heater block 36. The battery contact member 34 of beryllium copper or other suitable conductive material is imbedded in the plastic block 30 and has the lower end formed into a battery contact portion 38 and the upper end mounted to another plastic block 40. Also mounted to the plastic block 40 is another conductive strip 42 with a contact button 44 thereon adapted to contact the contact button 24. The heater block 36 consists of conductive members 46 and 48 which overly, respectively the conductive strip 34 and 42 when the connecting members 50 and 52 in the plastic block 54 are inserted, respectively, into the openings 54 and 56 of the plastic block 40. A resistance heater element 58 of nichrome or other suitable material interconnects the strips 34 and 42 to provide the cutting action when the buttons 44 and 24 are engaged. The heater block 36 is interchangeable with other heater blocks having a different spacing between the strips 34 and 42 to accommodate different yarn diameters.

OPERATION

Figure 3:
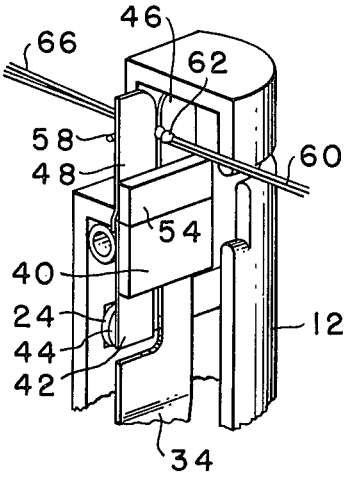
FIG. 3 is an enlarged isometric view of the top portion of the apparatus with part of the casing removed.
Figure 4:
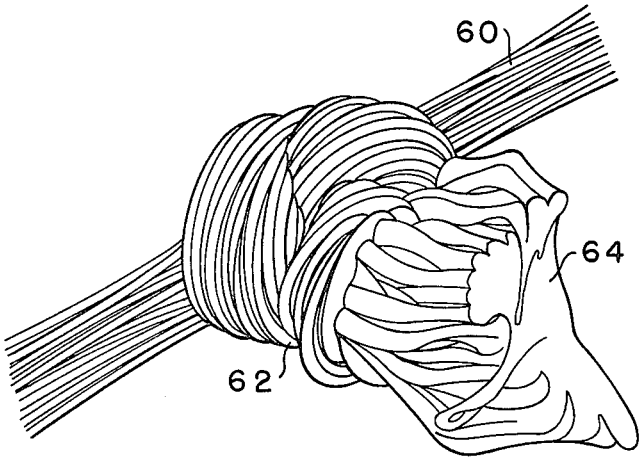
FIG. 4 is a blown-up view of the yarn knot produced by the apparatus of FIGS. 1–3.
Figure 2:
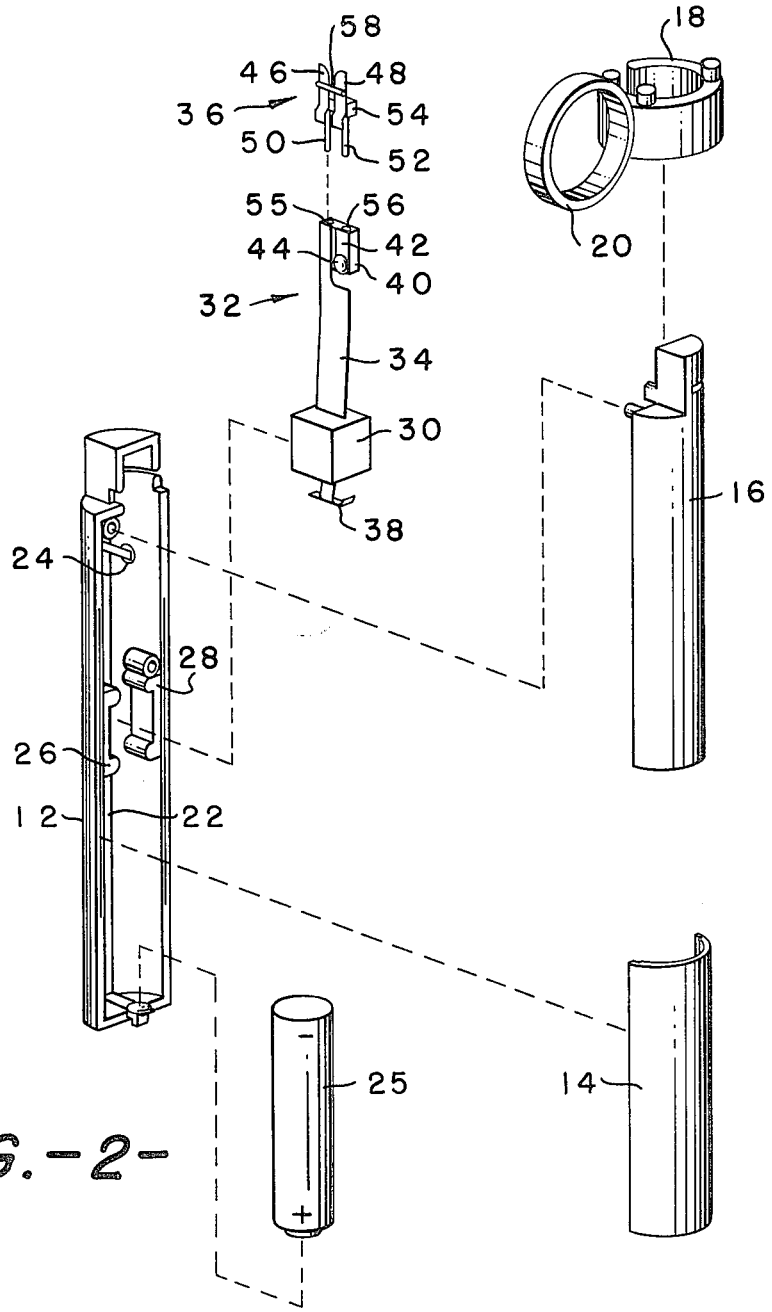
FIG. 2 is an exploded view of the yarn cutting apparatus shown in FIG. 1.

As noted above, it is desired to connect two ends of thermoplastic yarn, preferably polyester, together so that the connecting point, normally a knot, will not slip or get caught in the textile machine processing the yarn. To accomplish the above, the yarns 60 tied together with a chicken head knot 62 are placed in the device 10 through the slot 68 between the casing members 12 and 16 as shown in FIG. 3, with the yarns 60 and the knot 62 on the right hand side of the plates 46 and 48 and the tailing ends 66 of the yarn on the other side. The tailing ends 66 are pulled to the left until the knot 62 engages the slots between the plates 46 and 48 and bends the plates until the button 44 engages the button 24 to complete the circuit from the battery 25 through the resistance heater 58. When the heater 58 heats up, it will separate the yarn tails 66 from the knot 62 and allow the individual filaments to swell up to form the knot locking portion 64 to prevent the knot 62 from slipping.

The separation of the tail causes the contacts 24 and 44 to open, thus automatically stopping the flow of power to the resistance heater. This automatic feature eliminates the power waste of an operator dependent (on and off) switch. The result is extended life to the heating element and many more yarn cutting cycles without replacing the battery. Also, the yarn in the knot will not be exposed to needless overheating and strength degradation due to operator error in judgment of the time of the cutting cycle.

It is obvious that an apparatus has been described which will produce a yarn from two tied yarns which has a minimum size knot therein which will not slip and can be readily run through a textile processing machine without slippage or entanglement.

Although we have described in detail the preferred embodiment of the invention, it is contemplated that changes may be made without departing from the scope or spirit of the invention and it is desired that the invention only be limited by the scope of the claims.

That which is claimed is:

1. A self-contained apparatus to sever the tails of at least two tied yarns with a knot therein comprising: a housing; a source of power in said housing; a pair of flexible conductive members mounted in said housing operably associated with said source of power and spaced from one another, a resistance heater means connected to both of said conductive members, a slot in said housing adjacent the space between said conductive members to allow a tied yarn to be placed between said conductive members and means operably associated with said source of power and said conductive members to supply power to said heater means when said conductive members are bent by the engagement of the knot of said tied yarns.

2. A self-contained apparatus to sever the tails of at least two tied yarns with a knot therein comprising: a housing, a battery mounted in the lower portion of said housing and a yarn cutting apparatus in the upper part of said housing operably associated with said battery, said yarn cutting apparatus including a first conducting means in contact with said one end of said battery at one end and having spaced, flexible conductor members at the other end forming a slot therebetween, a resistance heating element connected to said conductor members and bridging said slot and a second conducting means in said housing in contact with the other end of said battery at one end and operably associated with said conductor members at the other to provide power to said heating element when said flexible conductor members are bent into contact with said second conducting means.

3. The apparatus of claim 1 wherein said first conducting means comprises at least two interconnected members with said spaced conductor members being mounted on one of said interconnected members.

4. A method to automatically sever the tails of a yarn knot in a tied yarn in an electrically heated yarn severing device having a pair of spaced, flexible conductor arms interconnected by a resistance heater and a battery operably associated with the conductor arms comprising the steps of: placing the tied yarn between the spaced conductor arm, pulling the yarn through the space until the yarn knot engages the conductor arms and supplying power to the resistance heater by pulling the knot against the spaced conductor arms to bend them over into conductive relationship with the battery.

* * * * *